US009358598B2

(12) United States Patent
Seidel et al.

(10) Patent No.: US 9,358,598 B2
(45) Date of Patent: Jun. 7, 2016

(54) METHOD AND APPARATUS FOR COOLING AND DRYING A HOT-ROLLED STRIP OR A METAL SHEET IN A ROLLING MILL

(75) Inventors: Jürgen Seidel, Kreuztal (DE); Peter Sudau, Hilchenbach (DE); Joachim Ohlert, Köln (DE); Ralf Wachsmann, Kreuztal (DE); Uwe Baumgärtel, Hilchenbach (DE)

(73) Assignee: SMS GROUP GMBH, Düsseldorf (DE)

( * ) Notice: Subject to any disclaimer, the term of this patent is extended or adjusted under 35 U.S.C. 154(b) by 0 days.

(21) Appl. No.: 13/059,885

(22) PCT Filed: Aug. 5, 2009

(86) PCT No.: PCT/EP2009/005660

§ 371 (c)(1),
(2), (4) Date: Mar. 16, 2011

(87) PCT Pub. No.: WO2010/020343

PCT Pub. Date: Feb. 25, 2010

(65) Prior Publication Data

US 2011/0162424 A1 Jul. 7, 2011

(30) Foreign Application Priority Data

Aug. 18, 2008 (DE) ..... 10 2008 038 277
May 29, 2009 (DE) ..... 10 2009 023 359

(51) Int. Cl.
*B21B 45/02* (2006.01)
*F26B 13/10* (2006.01)
(Continued)

(52) U.S. Cl.
CPC ..... *B21B 45/0281* (2013.01); *B26B 13/28* (2013.01); *B26B 21/14* (2013.01); *F26B 13/10* (2013.01); *B21B 45/0218* (2013.01)

(58) Field of Classification Search
CPC . B21B 45/0281; B21B 45/0218; F26B 13/10; F26B 21/14; F26B 13/28
USPC ..... 34/419, 422, 428, 443, 397, 398, 399, 34/404, 637, 654, 661, 62, 393, 491, 492, 34/550, 551, 558; 72/12.2, 11.3, 38, 200, 72/202, 342.2, 201, 236, 148, 250, 7.1, 72/7.2, 7.3, 7.4, 7.5, 7.6, 9.1, 11.7; 148/637, 654, 661, 559, 628; 266/62, 266/46, 113, 114
See application file for complete search history.

(56) References Cited

U.S. PATENT DOCUMENTS 2,656,285 A * 10/1953 Burns et al. ..... 427/320
3,622,404 A * 11/1971 Thompson ..... 148/558
(Continued)

FOREIGN PATENT DOCUMENTS

CN 1015014 12/1991
CN 1640575 7/2005
(Continued)

*Primary Examiner* — David Bryant
*Assistant Examiner* — Lawrence Averick
(74) *Attorney, Agent, or Firm* — Lucas & Mercanti, LLP; Klaus P. Stoffel

(57) ABSTRACT

A method for drying a strip (3) or sheet metal that runs through a rolling mill is characterized in that the strip (3) or the sheet metal is cooled to a lower temperature in a cooling section by means of a coolant, in particular a cooling liquid, down-stream of a hot strip mill (1) or, in case of sheet metal, after passing through at least one roll stand (2), and in that the coolant, in particular the cooling liquid, and subsequently the moisture remaining on the strip (3) or the sheet metal is removed from the strip (3) or sheet metal by means of a drying apparatus (10).

46 Claims, 7 Drawing Sheets

(51) Int. Cl.

| | |
|---|---|
| ***B26B 13/28*** | (2006.01) |
| ***B26B 21/14*** | (2006.01) |
| *F26B 21/14* | (2006.01) |
| *F26B 13/28* | (2006.01) |

(56) References Cited

U.S. PATENT DOCUMENTS

| | | | | | |
|---|---|---|---|---|---|
| 3,779,054 | A | * | 12/1973 | Greenberger | 72/12.2 |
| 4,403,492 | A | * | 9/1983 | Hope | 72/201 |
| 4,432,221 | A | * | 2/1984 | Barten | 72/148 |
| 4,440,584 | A | * | 4/1984 | Takeshige et al. | 148/503 |
| 4,551,878 | A | * | 11/1985 | Turley et al. | 15/102 |
| 5,021,265 | A | | 6/1991 | Bald | |
| 5,090,225 | A | * | 2/1992 | Schimion | 72/45 |
| 5,197,319 | A | * | 3/1993 | Beekel et al. | 72/268 |
| 5,775,152 | A | * | 7/1998 | Daub et al. | 72/39 |
| 6,006,574 | A | * | 12/1999 | Armenat et al. | 72/201 |
| 6,168,661 | B1 | * | 1/2001 | Dinkelman | 118/245 |
| 6,395,163 | B1 | * | 5/2002 | Schneider et al. | 205/93 |
| 6,675,622 | B2 | * | 1/2004 | Plicht et al. | 72/201 |
| 6,776,857 | B2 | * | 8/2004 | Lee | 148/661 |
| 6,938,359 | B2 | * | 9/2005 | Birgersson et al. | 34/445 |
| 7,485,197 | B2 | * | 2/2009 | Tanida | 148/325 |
| 7,677,072 | B2 | * | 3/2010 | Denker et al. | 72/236 |
| 7,721,744 | B2 | * | 5/2010 | Sabater Vilella | 134/49 |
| 8,050,792 | B2 | * | 11/2011 | Bergsten | 700/154 |
| 2001/0005525 | A1 | * | 6/2001 | Scheufler et al. | 427/195 |
| 2010/0175452 | A1 | * | 7/2010 | Ohlert et al. | 72/200 |

FOREIGN PATENT DOCUMENTS

| | | | |
|---|---|---|---|
| CN | 101080288 | | 11/2007 |
| CN | 101155651 | | 4/2008 |
| DE | 44749 | | 3/1888 |
| DE | 2844434 | A | 4/1980 |
| DE | 3431060 | A | 3/1986 |
| DE | 9320982 | A | 8/1995 |
| DE | 19535168 | | 3/1997 |
| DE | 19908743 | | 9/2000 |
| WO | 2006/109380 | | 10/2006 |

* cited by examiner

METHOD AND APPARATUS FOR COOLING AND DRYING A HOT-ROLLED STRIP OR A METAL SHEET IN A ROLLING MILL

The invention relates to a method for drying a continuously traveling strip or sheet metal in a rolling mill.

The present application is a 371 of International application PCT/EP2009/005660 filed Aug. 5, 2009, which claims priority of DE 10 2008 038 277.9, filed Aug. 18, 2008, and DE 10 2009 023 359.8, 2008, filed May 29, 2009, the priority of these applications is hereby claimed and these applications are incorporated herein by reference.

BACKGROUND OF THE INVENTION

In rolling mills and strip treatment plants, sheet metal and strips are dried after processing. Press rollers are used for the preliminary cleaning of sheet metal and strips. It has also already been attempted to remove remaining liquid residues by means of compressed air.

DE 28 44 434 A1 discloses a method for suctioning liquid residues from continuously traveling sheet metal and strips, particularly in rolling mills and strip treatment plants, in which in a defined area suction air flows produced by a negative pressure of at least 0.4 bar are guided transversely over the top side of the sheet metal and the bottom side of the sheet metal, and the absorbed liquid is separated from the suction air.

Moreover, in drying, and in keeping strips dry, particularly rolled strips, it is known to separate the dry area of the finished rolled hot strip from the moist chamber of the roll stand by means of bulkheads. In accordance with DE 199 08 743 A1, a contactless seal is produced between the bulkhead and the rolled strip by an aircushion-like compressed air padding as well as a split flow, for which purpose pressurized gas from a plurality of nozzles is directed from the top and bottom onto the strip surfaces and at a right angle onto the strip surfaces.

On the other hand, new types of steel have been marketed in recent years. Even though some of these steel qualities are distinguished by a particular deformability, the principal attention is directed to an increase of the achievable strength. For this purpose, plans of attack are available. By a rapid and targeted cooling of the strip by means of a guide cooling sections, a high strength can be achieved and simultaneously the rolling train can be relieved. For this purpose, however, usually low reel temperatures are necessary, which leads to difficulties during cooling, during coiling and particularly during further processing.

Strips from numerous types of steel newly developed in recent years, for example, of dual phase steel, martensite phase steel or QT-Steel (Q=quenched, T=tempered), are cooled following a hot strip train on a runout roller table directly or with a cooling interruption to relatively low temperatures, for example, in the range of between 25 and 400 degrees C., and are then coiled moist onto the coiler. A complete evaporation of the water is not possible within the coil produced by coiling. As a result, the strips are subjected to a greater oxidation. During long dwell times of the coil up to further processing, the pickling agent can no longer remove the rust from the surface. A direct further processing is not always possible which is a disadvantage with respect to quality as well as flexibility.

SUMMARY OF THE INVENTION

Therefore, it is the object of the invention to remove the above difficulties and to make available a method which avoids an oxidation of strips or of sheet metal after the end of the rolling process or at least significantly reduces the oxidation.

In accordance with the invention, this object is met by cooling the hot strip following a hot strip train or the sheet metal after traveling through at least one roll stand by means of a cooling liquid in a cooling section to a low temperature, and the cooling liquid and subsequently the moisture remaining on the hot strip or the sheet metal is removed by a drying device from the strip or the sheet metal.

In accordance with the invention, at least one device for strip drying is arranged following the cooling device. In the case of a steel strip, this ensures that the residual moisture is removed from the strip surface prior to coiling on the coil or stacking of sheet metal plates.

Advantageous further developments of the invention result from the dependent claims, the description and the drawings.

It is advantageous if the liquid on the hot strip or the sheet metal or in the area of the hot strip or the sheet metal, particularly in the area in front of the coiler is monitored by means of moisture sensors.

It is advantageously provided that the moisture sensors control or regulate adjusting members of the drying device, particularly for adjusting the quantity of drying medium or the pressure of the drying medium. In the area of the strip dryer, these measurement values can be reliably determined. This is a requirement for reliably adjusting the adjusting members of the cooling section, such as spray nozzles, or valves for adjusting the water quantity or the water distribution, and can therefore be utilized for the temperature regulation. Preferably, the temperatures or the temperature distribution on the surface of the strip or sheet metal are determined.

The temperature signals or the measured temperature distributions permit conclusions concerning the state of moisture on the strip surface and can be utilized for this purpose as an indicator. Accordingly, a temperature scanner can also be used as a moisture sensor.

The detected moisture state is stored in a process model. Depending on the data, the further processing of the coil can be concluded (recoiling, directly further processing, storing, etc.).

By means of the determined temperatures or the determined temperature distribution on the surface of the hot strip or the sheet metal, advantageously the adjusting members of the cooling section, particularly spray nozzles or valves, are adjusted for adjusting the water quantity, the ratio of the water quantity supplied from the top to the water quantity supplied at the bottom, as well as the water distribution over the width of the strip or the sheet metal.

In the area of the drying device, advantageously roller or rolls are used which squeeze the cooling liquid from the surface of the strip or the sheet metal.

Preferably, additionally a fluid, particularly further cooling liquid, is applied for removing the cooling liquid layer adhering to the sheet metal or the hot strip, wherein the application is against the travel direction of the strip or the sheet metal.

Preferably, the strip or the sheet metal is dried by means of a pressurized gas, particularly by means of compressed air. Depending on the requirements, the gas may be blown optionally onto the upper side or onto both sides of the strip or sheet metal.

In particular, it is advantageously provided that the compressed air is produced by means of a blower, compressed air nozzles or a compressed air station or air quantity amplifier, and is blown in a suitable direction, for example, against and transversely of the strip travel, onto the strip or sheet metal or in a gap or corner formed by a roller formed by the strip or the sheet metal. The drying effect can additionally be supplemented and improved by suitable positions, negative pressures zones, for example, suctioning devices. The roller can be, for example, a driver roller. Hot or cold air can be introduced into a gap formed by a roller and the strip, wherein the air is automatically deflected in the gap toward the sides of the strip or the sheet metal and entrains water droplets.

Also advantageous is a method in which moisture remaining on the strip or sheet metal is removed by means of flames and gases produced by heating burners.

Any moisture remaining on the strip or sheet metal can also be removed by means of liquid gas, particularly liquid nitrogen. The quantity of the liquid gas is advantageously dimensioned in such a way that the strip or the sheet metal is additionally cooled.

The invention also relates to a rolling mill for rolling a strip or sheet equipped with a cooling section.

In accordance with the invention, the rolling mill is characterized that following the cooling section is provided a drying device with at least one device for removing the cooling liquid and at least one device for removing residual moisture remaining on the strip or sheet metal.

It is advantageous if in or behind the drying device are arranged sensors for securely measuring the temperature, particularly the temperature distribution. On the basis of the measured temperature distribution, advantageously adjusting members are used in a cooling section arranged in front of the drying device, particularly spray nozzles or valves, for adjusting the quantity of the cooling liquid, for adjusting the cooling medium supply from the top or from below, as well as over the width of the strip or sheet metal, wherein the adjusting members are particularly part of a regulating device or a plurality of regulating devices.

For removing a large portion of the cooling water resting on the strip, the drying device includes rolls or rollers on which the strip or sheet metal is conducted past, and which squeeze the cooling liquid from the strip or sheet metal. Preferably, these rolls have an additional further function, for example, as deflecting rolls, straightening rolls or driver rolls. The rollers include a metal or plastic surface or another elastic material at the surface, or they have the shape of a roller brush. Either only a pair of rollers or a plurality of pairs of rollers or individual rollers are provided for this purpose.

The process of squeezing off the excess water advantageously takes place through the additional use of water spray beams arranged in the travel direction of the strip or sheet metal, wherein water is sprayed from the water spray beams against the travel direction of the strip or sheet metal. In the same manner, devices can be arranged which spray the water transversely of the travel direction of the strip or sheet metal. Also, several spray beams arranged one behind the other can be arranged in front of a roller.

In particular in the area of the rollers, for example the drive rollers, lateral strip guides are provided which have openings for leading away the cooling liquid or the water.

A particularly efficient type for removing the moisture from the strip or sheet metal provides that the drying device comprises a compressed air dryer. Depending on the cooling section, the compressed air drying can be used also without the presence of a pressing roller. In this case, a high-pressure longitudinal spray pushes back any water present on the sheet metal or strip.

Preferably, the compressed air dryer is equipped with a blower. This blower preferably has one or several ventilators. The ventilator takes in air which is blown over guide plates and one or more, particularly rectangular, air nozzles against and transversely of the travel direction of the strip or sheet metal.

Optionally, in accordance with an advantageous further development, the outlet width of the air nozzles can be adapted by adjustable side plates to the width of the strip or sheet metal. By corresponding arrangements of nozzles, and a properly selected nozzle size, varying effects over the width of the strip can be produced. Also, a targeted arrangement of the nozzles or the slots, for example, only at the strip edge or only in the middle portion of the strip, is possible. Compressed air drying can be used either only on the upper side of the strip or on both sides of the sheet metal. Also in this case, the airflow is directed either as such against the strip or preferably also is deflected, particularly on the outlet side, into the gap or corner of a roll, such as a driver roll.

In special cases, moveable floating nozzles are provided on the upper side of the strip in the form of an aircushion device, wherein the nozzles are used as additional means for removing residual moisture from the strip.

Instead of a blower arranged above or below the strip, it is also possible to produce the airflow next to the strip or in an external compressed air station. Instead of cold air, it is alternatively also possible to produce hot air, particularly in combination with hot gas, for example as a waste product from another device of the plant.

Preferably, it may also be provided that the drying device includes sensors for measuring the flatness of the strip or the sheet metal, which are arranged particularly in the travel direction behind the strip dryer.

Alternatively or in combination with the above-mentioned devices, the rolling mill may also comprise a heating burner. In such a heating burner, several burners arranged over the width of the strip, particularly DFI-burners (DFI=direct flame impingement) are directed against the strip. In certain cases it is also sufficient to use only a single burner. Because of the high flame temperature, the residual water evaporates on the surface of the strip. The flame adjustments are dimensioned in such a way that during the drying process only a slight temperature increase of the strip takes place and the strip properties are not negatively affected as a result. The waste gases of the burner are removed through a suctioning device. The roller table rollers are constructed so to be heat resistant in the burner area.

In accordance with another advantageous further development the drying device comprises an arrangement, particularly a spray nozzle beam, for applying a liquid gas, particularly liquid nitrogen, to the surface of the strip or sheet metal. In this connection, for example, liquid nitrogen is injected or sprayed against the strip from nozzles arranged on one or more distribution pipes. The nitrogen cools the moisture which is still present on the strip into small ice particles; subsequently, the ice sublimates and escapes together with the evaporating nitrogen from the strip surface. The strip is dried in this manner. The water steam or the water gas and gaseous nitrogen are once again suctioned off or blown off behind the spraying device.

Depending on the type of steel, the use of the liquid nitrogen is also utilized for simultaneously effecting an additional cooling of the strip to lower temperatures and a positive influence on the mechanical properties by stabilizing or converting the not yet converted residual austenite.

Another possibility for drying the strip or the sheet metal resides in the drying device including an induction heating unit or a radiation dryer, particularly an infrared dryer or a microwave radiation dryer.

Additionally, the drying device comprises in an advantageous manner a device for suctioning off moisture from the surface of the strip or the sheet metal.

Moreover, additional radiation dryers and/or devices for suctioning off moisture and/or spray nozzle beams can advantageously be used for applying a liquid gas to the surface of the strip in the area of a coiled driver or coiler arranged following the drying device.

Preferably, in the area of the drying device, additionally a device is provided which places the strip or the sheet metal in vibrations, particularly by means of a pulsating airflow or pulsating magnetic field, by longitudinally offset rolling rollers. The pulsating airflow can be produced, for example, by a rotating air flap. Because of the vibration, the water droplets separate more easily from the strip, so that they can be blown off or suctioned off more easily.

The coils consisting of the coiled strip can be further dried, particularly by blowing. Preferably, the coils are stored in a drying chamber, hot air chamber, or hot gas chamber. The devices utilized in the area of drying of the strip can at least partially be used in the area of the coilers on which the coiler is coiled.

All devices for removing the cooling water and/or the moisture from the strip or sheet metal can be mounted so as to be stationary or so as to be pivotable or driven as desired into the transport line of the strip, or they can be lowered or moved in the direction of the travel plane of the strip.

The utilization of the device takes place in dependence on the reel temperature, for example, in strips having a temperature of less than 400° C., and dependent on the thickness of the strip. The activation of the individual units for removing the cooling water and the drying and dehumidifying units takes place preferably by means of a central computing and regulating unit, particularly by a process computer.

The different devices for drying and dehumidifying the strip can be used individually or also in any desired combination.

Moreover, the various devices for drying and dehumidifying the strip or coil can be mounted in a separate strip coiling plant and may be possibly combined with other process steps.

BRIEF DESCRIPTION OF THE DRAWING

In the following, the invention will be explained in more detail in embodiments with the aid of the drawings.

In the drawing.

DETAILED DESCRIPTION OF THE INVENTION

Figure 1:
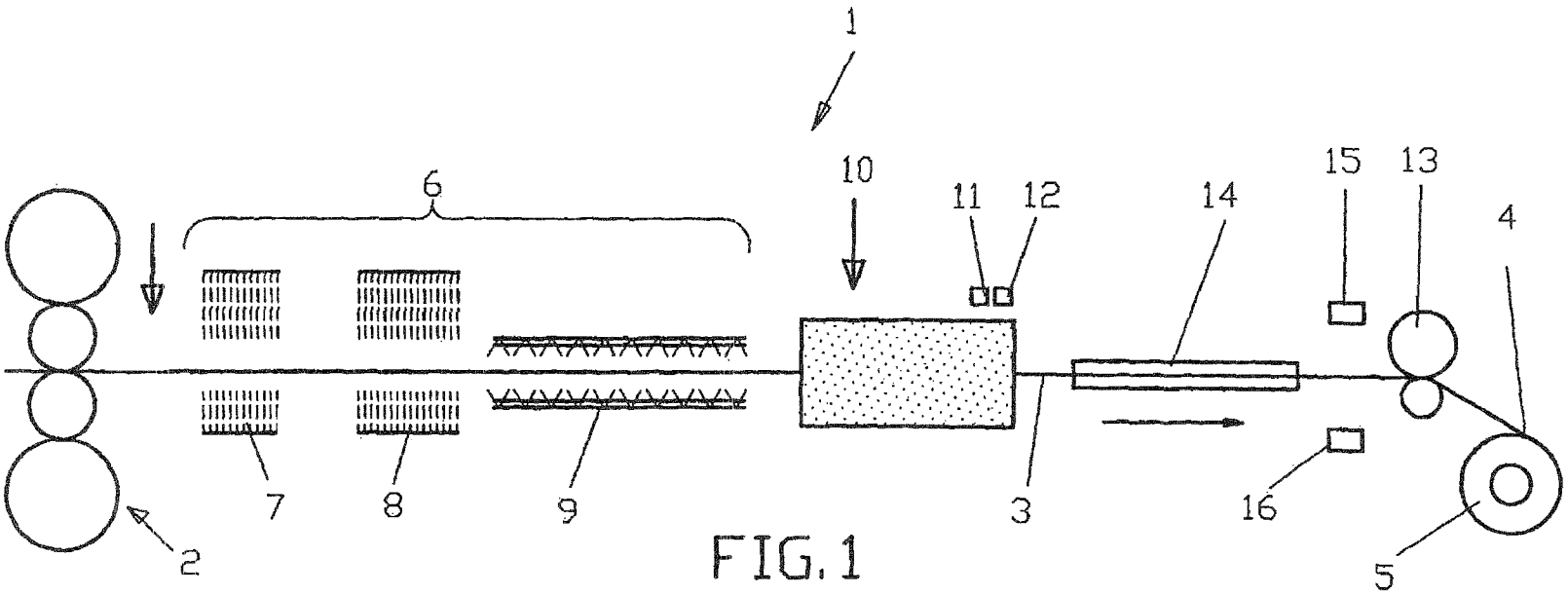
FIG. 1 shows a hot strip train for rolling hot strip from the last roller stand with a cooling device, a drying device and a reel.

A hot strip train 1 (FIG. 1) comprises a plurality of roll stands of which the last roll stand 2 is illustrated, for rolling a hot strip 3 and for feeding it to a coiler 4 where it is wound up into a coil 5.

Since the strip 3 after traveling through the roll stand 2 still has a temperature of several hundred degrees Celsius, it must be cooled. For this purpose, a cooling device 6 which comprises different cooling units, for example, a plurality of devices 7, 8 for a laminar strip cooling by means of a cooling agent, for example, radiation in the laminar flow with cooling liquid, particularly with cooling water. Moreover, by means of a device 9 for intensive cooling or for spray cooling, cooling water is sprayed onto the strip 3. Preferably, the devices 7 to 9 are mounted on the bottom side and the upper side of the strip 3, so that after traveling through the cooling device 6, the strip 3 still has a temperature which is, for example, below 400 C. Subsequently, the strip 3 is further conducted in a strip dryer 10 black-box, which removes the moisture from the surface of the strip 3. In this area, the strip 3 is dried, for example, with a longitudinal water spray combined with a compressed air device. The strip dryer 10 comprises preferably also a temperature scanner or a temperature sensor 11 as well as a planeness measuring device 12. The temperature sensor 11 measures the temperature of the strip 3 preferably bolometrically, i.e., by measuring the radiation spectrum radiating from the strip 3. Therefore, it is necessary to screen the temperature sensor 11 relative to other radiation sources, for example, lamps, ambient light, etc. which are found in the measuring area and are captured there. For this purpose, suitable is, for example a cover which is impermeable to radiation above or possibly next to the measuring area.

A safe and accurate strip temperature determination improves the temperature control and can be utilized in a targeted manner in order, for example, to adjust a coil winding temperature of 200° C. where evaporation of the water just still takes place.

The planeness measuring device 12 determines the planeness of the strip 3 in order to be able to, if necessary, adjust adjusting members for influencing the planeness. For example, the hot strip planeness following the rolling train 2 and the strip temperature distribution over the strip width can be influenced in a targeted manner.

In the area of the dry surface it is also possible in an advantageous manner to install a surface inspection device.

In the area of the roll stands 2 as well as in the area of the cooling device 6 and following the strip dryer are lateral guides for guiding the strip 3 as intended by the lateral guidance 14. Moisture sensors 15, 16 in the runout area of the hot strip train 1 register any residual moisture which is still just present in order to supply appropriate signal values to a regulator for regulating the supply of a drying medium in the strip dryer 10. Temperature scanners with appropriate temperature evaluation methods may also serve as moisture sensors.

Figure 2A:
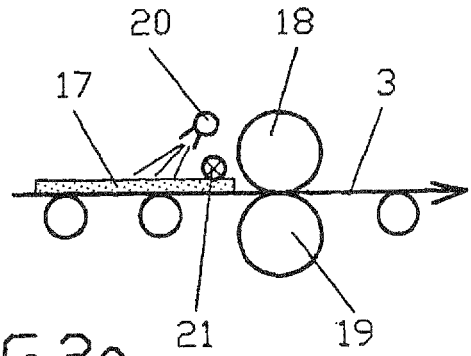
FIGS. 2*a-c* show various arrangements of rollers for removing cooling liquid from the surface of the hot strip.
Figure 2B:
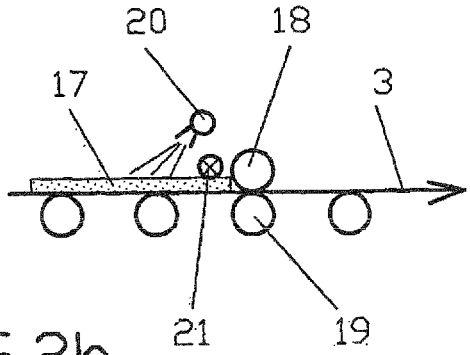
Figure 2C:
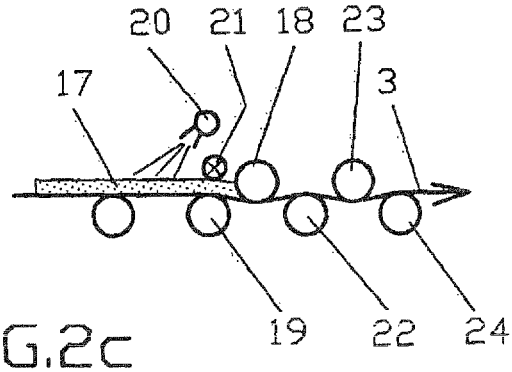

For removing a liquid layer 17 (FIGS. 2*a*, 2*b*, 2*c*) of a cooling liquid, particularly of water, applied by a cooling device onto a strip 3, roller 18 are suitable which form a pair of rollers together with a roller 19 mounted on the bottom side. The pair of rollers 18, 19 either has only the task of removing the liquid, however it may additionally meet further functions by serving for driving the strip 3 or by mounting the two rollers 18, 19 for straightening the strip 3, wherein at least one of the two rollers 18, 19 is vertically adjustable or can be adjusted in the strip travel direction.

The squeezing effect of the rollers 18, 19 for removing the liquid film on the strip 3 is further reinforced by the fact that a water spray beam 20 or a blowing device for blowing compressed air, in particular directed against the travel direction of the strip 3, removes a significant portion of the cooling liquid by sprayed-on water or blown compressed air, before the cooling liquid reaches the gap between the roller 18 and the strip 3. Alternatively, or additionally, another water spray beam 21 or compressed air beam can be used for introducing compressed air transversely of the travel direction of the strip 3 to remove the water layer from the strip 3.

In addition, several rollers 18, 19, 22, 23, 24 (FIG. 2*c*) can be arranged behind one another offset relative to the strip 3 in order to squeeze off the liquid layer 17, wherein also several of these rollers 18, 19, 22, 23, 24 have different functions, for example, to serve additionally as driver or straightening rolls.

In another embodiment (FIG. 3), the arrangement of rollers 18, 19 serving for removing the cooling liquid layer 17 is provided with a device 25 for compressed air drying which depending on the application can also be used without the pressing rollers 18, 19. In the device 25, a high-pressure longitudinal spray forces the cooling liquid from the strip 3. The device 25 comprises additionally above and preferably also below the strip 3 a blower 26 with several ventilators arranged next to each other for suctioning the air. Through guide plates 27 and one or more air nozzles 28, 29, 30, the compressed air is blown against the strip surface, preferably against the travel direction of the strip. Also in this embodiment, preferably under a cover 31 for screening harmful foreign radiation, a temperature sensor 11 and the planeness measuring device 12 are provided in order to determine the properties of the strip 3, so that if also the blowers 26 are integrated in a regulating circuit, appropriate adaptation of the temperature and/or the intensity of the compressed air blowing against the strip 3 can be carried out as well as means for improving the planeness of the strip 3 can be utilized.

In accordance with another alternative of the invention (FIG. 4), after the strip 3 has traveled between the pressing rollers 18, 19, several heating burners 32 to 35 are, preferably directed from the upper as well as from the lower side of the strip against the strip 3 in order to dry the strip. Because of the high flame temperature, the residual water still remaining on the strip 3 evaporates. The flame adjustments are dimensioned in such a way that they do not negatively affect the strip properties even considering the evaporation heat required of the water. The waste gases of the burners 32 to 35 are suctioned off by a suctioning device 36. Roller table rollers 37 on the bottom side of the strip 3 are constructed so as to be heat resistant in the area of the burners 34, 35.

In accordance with another arrangement (FIG. 5), the moisture is removed with the use of spray devices 38 to 40 which apply a liquid gas, especially liquid nitrogen, to the strip 3 which cools the water to ice. The evaporating nitrogen entrains the water with it, wherein this water also evaporates. The suctioning device 36 suctions off the nitrogen as well as the water. Alternatively or additionally, also an air blower is provided behind the spraying device.

Figure 5:
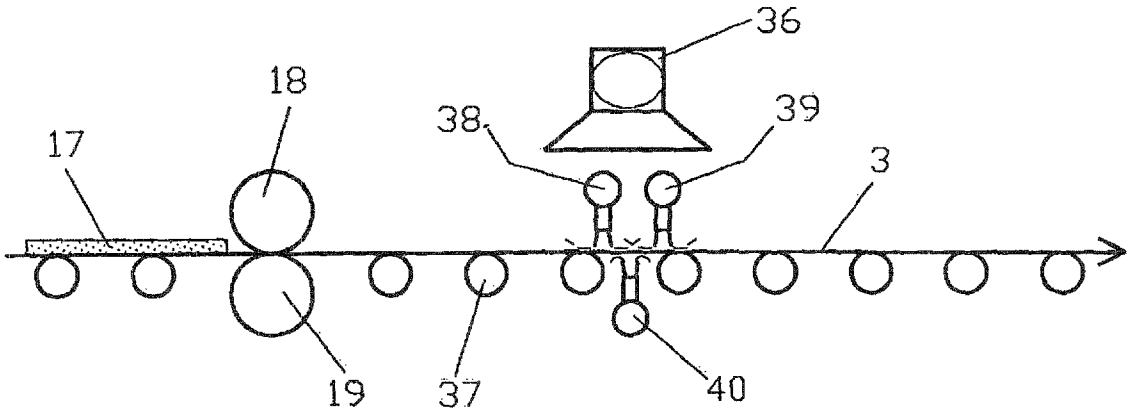
FIG. 5 shows an arrangement with liquid spray nozzle beams for removing the cooling liquid and for subsequently dehumidifying the strip.

The spraying device 38-40 can be arranged in the area of the roller table rollers as illustrated in FIG. 5. An arrangement of the spray device directly following the coiler drive rollers 13 is also intended.

Figure 3:
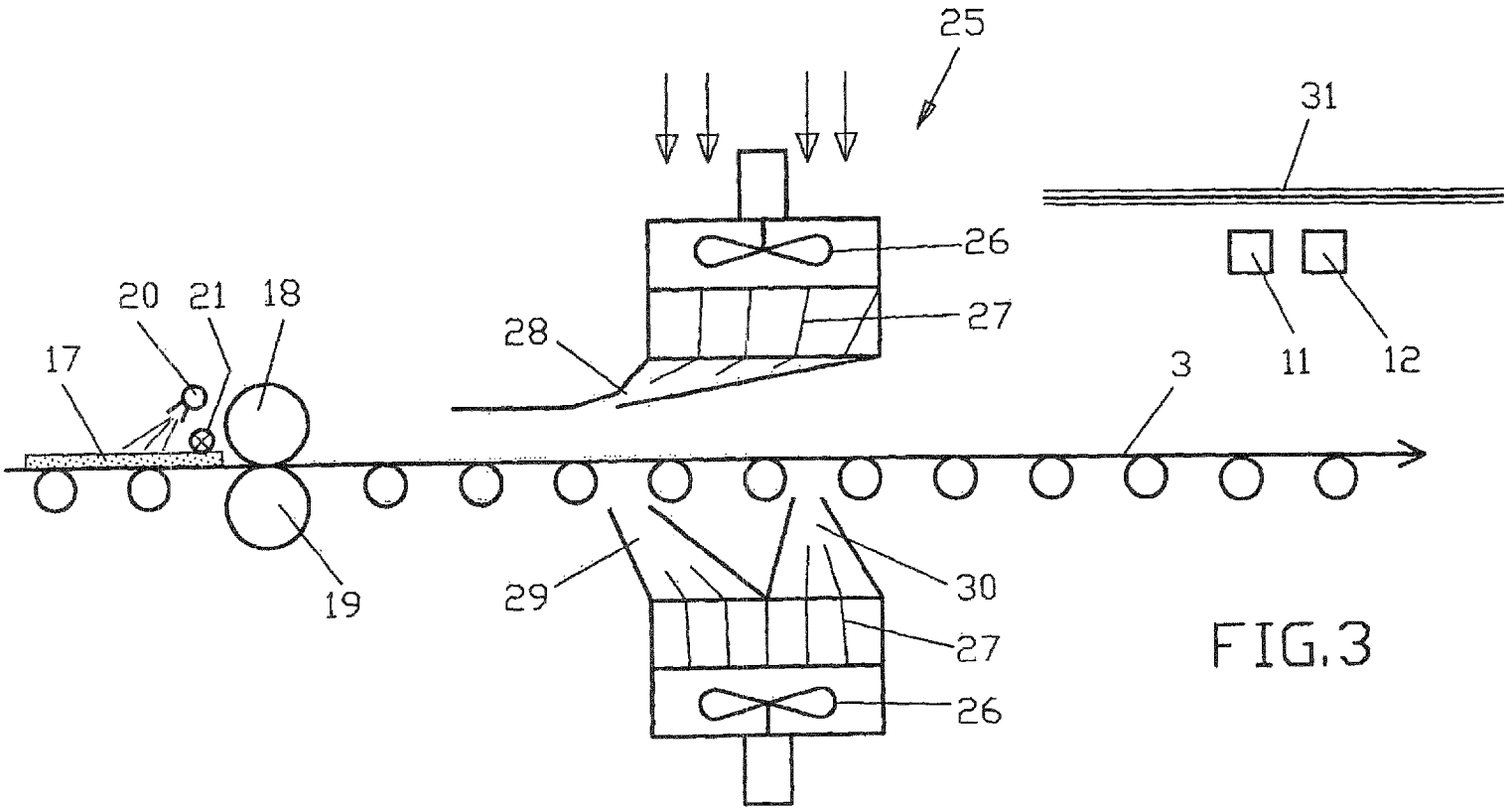
FIG. 3 shows a section following a hot strip train according to FIG. 1, wherein the drying device includes air nozzles with a blower on the upper and lower side of the hot strip.
Figure 4:
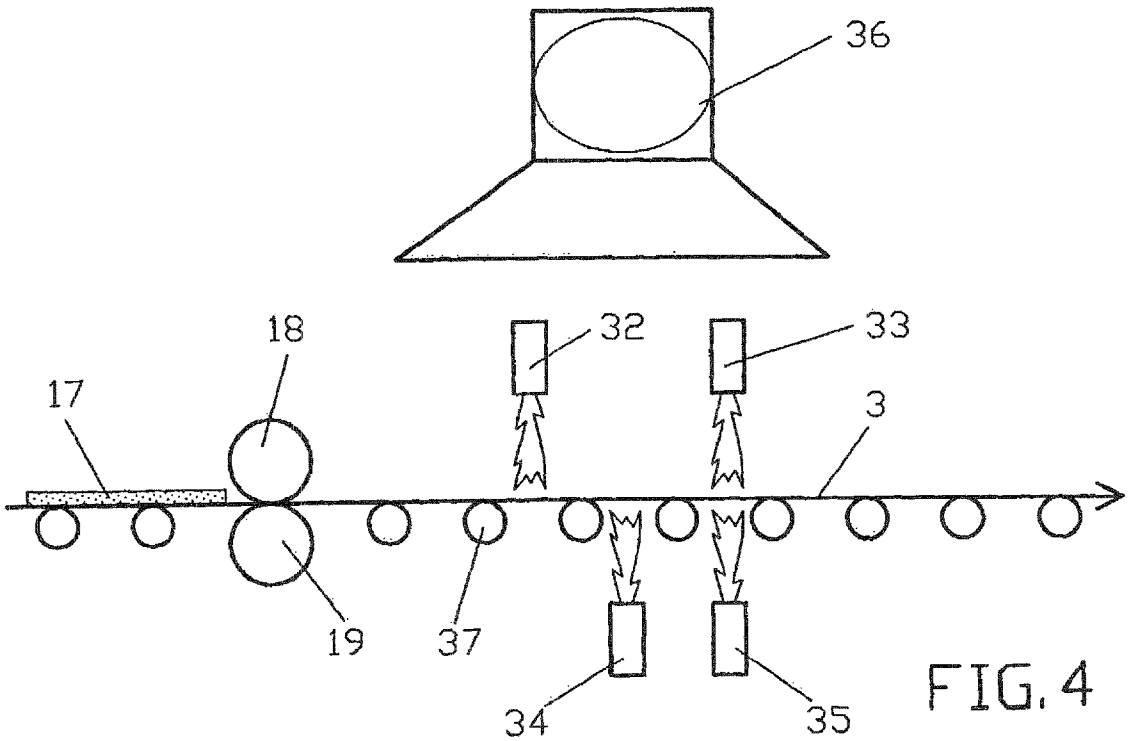
FIG. 4 shows an arrangement with burners for a stepwise removal of a cooling liquid from the strip surface and for drying the strip.
Figure 6:
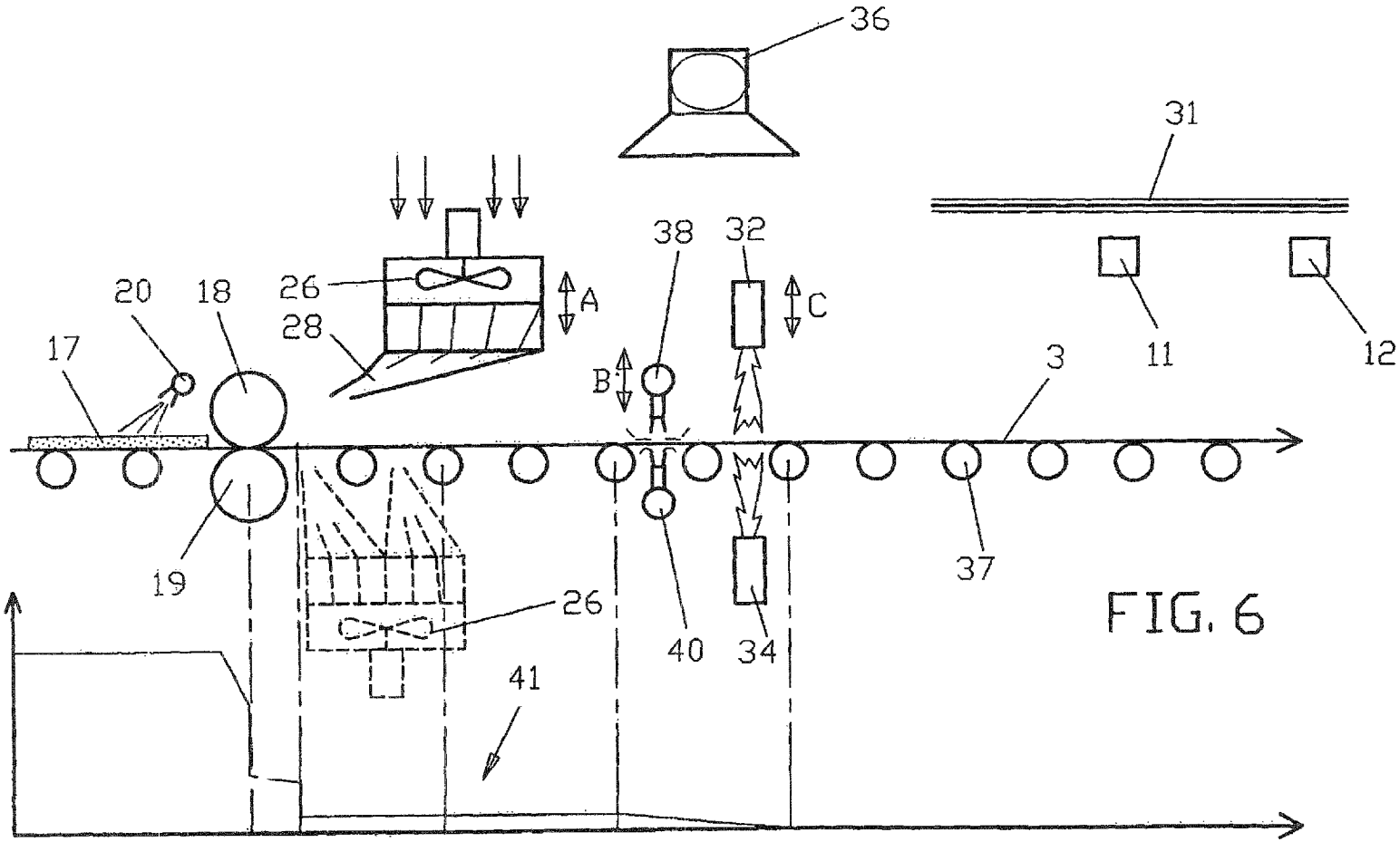
FIG. 6 shows another device for removing the cooling liquid with various devices for the complete drying of the strip, wherein in a graph is shown additionally the thickness of the water layer over the extent of the strip.

In accordance with another embodiment of the invention (FIG. 6), the measures illustrated in FIGS. 3 to 5 for drying the strip are combined with each other. In that case, in addition to the pressing rollers 18, 19 constructed additionally as drive rollers, provided are heat blower 26, raisable and lowerable in the direction of a double arrow A with an air nozzle 28 on the upper side of the strip 3, a spraying device 38 raisable and lowerable in the direction of a double arrow B, and a burner 32 raisable and lowerable in the direction of a double arrow C are provided one after the other. The spraying device 38 applies either liquid gas or hot air onto the strip 3. Evaporating gases and combustion gases are suctioned off by the suctioning device 36. The temperature sensor 11 and the planeness measuring device 12 are arranged underneath cover 31. A water spray beam 20 arranged in front of the drive roller 18 ensures an efficient and powerful longitudinal water spray.

Also from the bottom side of the strip 3 are arranged next to the roller table rollers 37 preferably an optional blower 26, the spraying device 40 and the burner 34. To ensure that the strip 3 remains dry during the manufacture of a strip 3 with a low strip temperature, it is possible to deactivate the cooling of the roller table rollers 37 behind the cooling section or the drying device, the drive rollers 18, 19, etc. Spraying devices and burners can possibly be utilized alternatively. Conventional ventilators ensure that the surroundings of the sensors and measuring devices 11 are free of any harmful fogs.

A graph 41 shows how over the travel of the strip 3 the various successive measures gradually remove the water layer 17 on the strip 3. The various units carry out a stepwise removal of the water from the strip 3.

Figure 7:
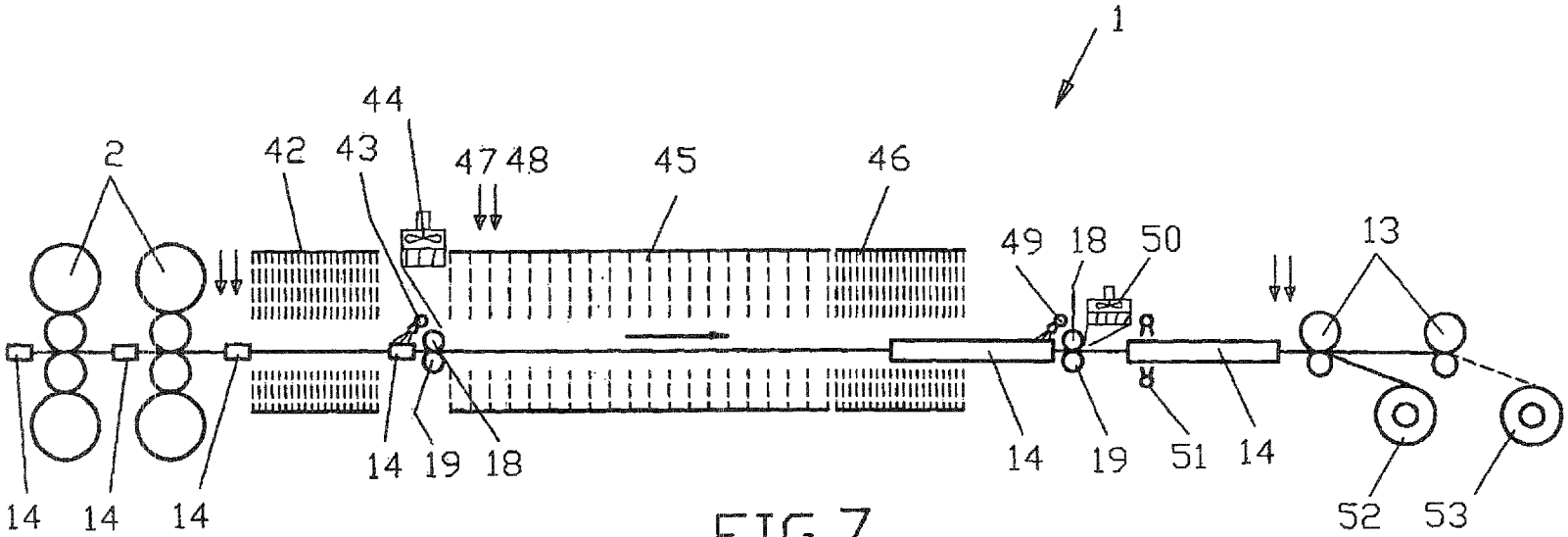
FIG. 7 shows another hot strip train leaning at the two last roll stands with devices for cooling and for drying the strip with two reels.

In accordance with another further development of the invention (FIG. 7), it is provided that a plurality of drying and cooling devices are arranged successively following the last roll stand 2, wherein the strip 3 is guided at various locations between the stand 2 and the coil drivers 13 by lateral guides 14. After the last roll stand 2, the strip 3 initially travels through a first device 42 for intensively cooling the strip and subsequently a spraying device 43 for pushing the cooling liquid back from the strip 3. Subsequently, the strip 3 travels for drying underneath a blower 44 for applying air onto the strip 3. The blower 44 is followed by a device 45 for the laminar strip cooling which is followed by another device 46 for intensive strip cooling. In the area of the device 45, a temperature scanner 47 and a planeness measuring device 48 may be arranged, as indicated by only two arrows.

Following the device 46 is arranged a water spray beam 49 for removing cooling liquid present on the strip 3. A pair of drive rollers 18, 19, alternatively also straightening rolls can be provided, is followed by a blower 50 for removing cooling liquid residues from the strip 3. Also, another drying device can be used instead of the blower 50. Subsequently the strip 3 travels at least through one spraying device 51 which applies a liquid gas in form of a spray for cooling and taking along moisture particles, particularly of water droplets, from the strip 3. Finally, the strip 3 is once again guided between coil drive roller pairs 13 before it reaches one of two reels 52, 53 where it is coiled into a coil.

Due to the use of dry rollers 18, 19, advantageously a strip tension is built up early up to the last active roll stand 2. This improves the uniformity of the strip cooling and reduces strip undulations, so that drying process is positively influenced. When the surface is almost dry, it is then also possible to determine the planeness and the temperature distribution at the beginning of the cooling section. Both values are then available for regulating purposes.

Various alternatives in the sequence of cooling and drying devices, for applying and removing fluids which are applied for cooling, can be realized in accordance with this invention. In this connection, the sequence of the devices can be adapted in such a way that the desired crystalline microstructures and structures within the strip 3 and, thus, the desired material properties are achieved. Arrangements for longitudinal spraying of the water and lateral air blowers which preferably are directed against the travel direction or transversely of the travel direction of the strip 3 can be provided in accordance with the invention.

Depending on the desired cooling curve, an intensive strip cooling can be carried out from the front and/or behind in the cooling section. In the same manner, the devices for separating the water for drying the strip, for building up a strip tension, etc. can also be carried out in the front and/or behind in the cooling section.

LIST OF REFERENCE NUMERALS

1. Hot strip train
2. Roll stand
3. Strip
4. Coiler
5. Coil
6. Cooling device
7. Device for laminar strip cooling
8. Device for laminar strip cooling
9. Device for spray cooling
10. Strip dryer
11. Temperature sensor
12. Planeness measuring device
13. Coiler drive roller
14. Lateral guide
15. Moisture sensor
16. Moisture sensor
17. Liquid layer
18. Roll
19. Roll
20. Air spray beam (longitudinal)
21. Air spray beam (lateral)
22. Roll
23. Roll
24. Roll
25. Compressed air dryer
26. Blower
27. Guide plate
28. Air nozzle
29. Air nozzle
30. Air nozzle
31. Cover
32. Burner
33. Burner
34. Burner
35. Burner
36. Suctioning device
37. Roller table rollers
38. Spray device
39. Spray device
40. Spray device
41. Graph
42. Device for intensive cooling
43. Spraying device
44. Blower
45. Device for the laminar strip cooling
46. Device for the intensive strip cooling
47. Temperature scanner
48. Planeness measuring device
49. Water spray beam
50. Blower
51. Spraying device
52. Reel
53. Reel

The invention claimed is:

1. A method for drying a continuously traveling metal strip or metal sheet in a rolling mill, comprising the steps of:

cooling the metal strip directly following a hot strip train or the metal sheet after traveling through at least one roll stand in a cooling section by a cooling agent to a low temperature;

removing the cooling agent and subsequently moisture remaining on the metal strip or the metal sheet from the metal strip or on the metal sheet by a drying device directly following the cooling section; and ensuring that the cooling agent and the moisture have been removed from the metal strip or the metal sheet by monitoring the moisture on the metal strip or the metal sheet or in the area of the metal strip or of the metal sheet by moisture sensors outside the drying device in an outlet region of the hot strip train where the metal strip leaves the strip train.

2. The method according to claim 1, including coiling the strip on a reel or stacking the sheet metal after drying.

3. The method according to claim 2, wherein the moisture sensors control or regulate adjusting members of the drying device for adjusting a quantity of a drying medium or a pressure of a drying medium.

4. The method according to claim 1, including using measured temperature signals as indicators for moisture quantity and, thus, as moisture sensors.

5. The method according to claim 1, including determining a measured moisture state by a process model and depending therefrom concluding a further treatment of the strip or sheet.

6. The method according to claim 1, including determining a temperature distribution on a surface of the strip or the sheet metal.

7. The method according to claim 6, including screening out other radiation sources, above and next to a measuring area so as to provide a secure temperature determination.

8. The method according to claim 7, including adjusting members of the cooling section with aid of the securely determined temperature distribution on a surface of the strip or the sheet metal.

9. The method according to claim 8, wherein the adjusting members include spray nozzles or valves for adjusting a cooling agent quantity, a ratio of the cooling agent quantity supplied at a top relative to the cooling agent quantity supplied from below, as well as a cooling agent distribution over a width of the strip or the sheet metal.

10. The method according to claim 1, wherein the cooling agent is a cooling liquid, the method further including squeezing the cooling liquid off from a top side and a bottom side of the strip or the sheet metal with rollers.

11. The method according to claim 10, further including applying an additional fluid for removing the cooling agent layer adhering to the sheet metal or the strip again or transversely to a travel direction of the strip or the sheet metal.

12. The method according to claim 1, including drying the strip or sheet metal by a pressurized gas.

13. The method according to claim 12, wherein the pressurized gas is compressed air.

14. The method according to claim 13, including producing the compressed air flow with a blower, a compressed air station or air quantity amplifier, and blowing the compressed gas against or transversely of a strip travel direction onto the strip or the sheet metal or from a gap or corner formed by a roller with the strip or the sheet metal.

15. The method according to claim 1, including drying the strip or the sheet metal over an entire width.

16. The method according to claim 1, including removing moisture remaining on the strip or the sheet metal with flames produced by heating burners.

17. The method according to claim 1, Including removing moisture remaining on the strip or the sheet metal with a liquid gas.

18. The method according to claim 17, wherein the liquid gas is liquid nitrogen.

19. The method according to claim 17, including dimensioning a quantity of the liquid gas so that the strip or the sheet metal is also cooled.

20. A rolling mill for rolling a metal strip or metal sheet in a hot strip train, the rolling mill comprising:

a hot strip train;

a cooling section directly following the hot strip train;

a drying device directly following the cooling section, the drying device including at least one device for removing cooling liquid, and at least one device for removing residual moisture remaining on the metal strip or the metal sheet; and moisture sensors arranged outside the drying device in an outlet region of the hot strip train where the metal strip leaves the strip train for monitoring the metal strip or the metal sheet to ensure the cooling liquid and the residual moisture are removed.

21. The rolling mill according to claim 20, wherein the drying device comprises sensors for measuring temperature.

22. The rolling mill according to claim 21, wherein the sensors measure temperature distribution.

23. The rolling mill according to claim 22, further comprising a screen or cover arranged above and optionally next to a temperature measuring area so as to block external radiation influence.

24. The rolling mill according to claim 23, wherein adjusting members are arranged in front of the drying device and are adjustable based on the measured temperature distribution for adjusting a cooling liquid supply from above or from below as well as over a width of the strip or the sheet metal, wherein the adjusting members are parts of at least one regulating device.

25. The rolling mill according to claim 24, wherein the adjusting members are spray nozzles or valves for adjusting the quantity of the cooling liquid.

26. The rolling mill according to claim 21, further comprising at least one heating burner.

27. The rolling mill according to claim 20, wherein the drying device comprises rollers along which the strip or the sheet metal can be guided, and which squeeze the cooling liquid from the strip or the sheet metal.

28. The rolling mill according to claim 27, wherein the rollers additionally serve as deflection rollers, drive rollers or straightening rollers.

29. The rolling mill according to claim 27, wherein the rollers have a metal surface, a synthetic material surface or an elastic material at the surface.

30. The rolling mill according to claim 27, further comprising water spray beams arranged in front of the rollers in or transversely of a travel direction of the strip or the sheet metal so that water is sprayed from the water spray beams against or transversely of the travel direction onto the strip or the sheet metal.

31. The rolling mill according to claim 20, further comprising strip guides in an area of the drying device, the strip guides having openings for removing the cooling liquid.

32. The rolling mill according to claim 21, wherein the drying device comprises a compressed air dryer.

33. The rolling mill according to claim 32, wherein the compressed air dryer includes a blower.

34. The rolling mill according to claim 33, wherein the blower comprises at least one ventilator and takes in air which can be blown over guide plates and over at least one air nozzle against a travel direction of the strip or the sheet metal.

35. The rolling mill according to claim 34, wherein an outlet width of the spray nozzles is adjustable by adjustable lateral plates to a width of the strip or the sheet metal.

36. The rolling mill according to claim 35, wherein the air nozzles are arranged to blow from the side transversely or obliquely relative to the strip and deflect water droplets sideways.

37. The rolling mill according to claim 32, wherein the drying device comprises sensors for measuring planeness of the strip or the sheet metal, arranged behind the compressed air dryer in the travel direction.

38. The rolling mill according to claim 20, wherein the drying device comprises nozzles formed as an air cushion device.

39. The rolling mill according to claim 20, wherein the drying device comprises at least one spray nozzle beam for applying a liquid gas to the surface of the strip or the sheet metal.

40. The rolling mill according to claim 39, wherein the nozzle beam is arranged to apply the liquid gas in an area of roller table rollers or directly following reel drive rollers.

41. The rolling mill according to claim 20, wherein the drying device comprises a radiation dryer.

42. The rolling mill according to claim 41, wherein the radiation dryer is an infrared or microwave radiation dryer.

43. The rolling mill according to claim 20, wherein the drying device comprises a device for suctioning moisture from the surface of the strip or the sheet metal.

44. The rolling mill according to claim 20, wherein additional radiation dryers and/or devices for suctioning off moisture are arranged in an area of a reel arranged following the drying device.

45. The rolling mill according to claim 20, further comprising a device for vibrating the strip or the sheet metal.

46. The rolling mill according to claim 45, wherein the vibrating device includes roller table rollers that are offset relative to each other in a longitudinal direction.

* * * * *